US005725134A

United States Patent [19]

Weltge

[11] Patent Number: 5,725,134

[45] Date of Patent: Mar. 10, 1998

[54] SUPPORTING DEVICE AND METHOD FOR PRESERVING THE SHAPE AND INTEGRITY OF A CAP

[76] Inventor: Brian Richard Weltge, 715 E. Schantz Ave., Dayton, Ohio 45419

[21] Appl. No.: 789,820

[22] Filed: Jan. 28, 1997

Related U.S. Application Data

[63] Continuation of Ser. No. 593,262, Jan. 29, 1996.

[51] Int. Cl.[6] ..... A42C 1/00; D06C 15/00

[52] U.S. Cl. ..... 223/24; 223/84

[58] Field of Search ..... 223/24, 25, 26, 223/84

[56] References Cited

U.S. PATENT DOCUMENTS

| | | | |
|---|---|---|---|
| 210,771 | 12/1878 | Eickmeyer . | |
| 1,845,076 | 2/1932 | Copeland | 223/24 |
| 2,536,913 | 1/1951 | Cox et al. . | |
| 3,254,757 | 6/1966 | Raskin | 223/24 |
| 4,491,256 | 1/1985 | Payne et al. | 223/24 |
| 4,805,782 | 2/1989 | Hale et al. | 223/84 |
| 4,941,601 | 7/1990 | Thomas et al. . | |
| 4,998,992 | 3/1991 | Richlin et al. | 223/84 |
| 5,148,954 | 9/1992 | Myers | 223/24 |
| 5,161,719 | 11/1992 | Oheson | 223/84 |
| 5,172,837 | 12/1992 | Finney, Jr. | 223/84 |

*Primary Examiner*—Bibhu Mohanty

*Attorney, Agent, or Firm*—Killworth, Gottman, Hagan & Schaeff, L.L.P

[57] ABSTRACT

A support device for a cap is formed as a block of compressible, resilient material shaped generally to conform to the inside of a cap and sized somewhat larger than a cap to be supported. The support device is compressed, inserted into a cap, and released to secure the device within the cap. The cap supporting device can be used to support a cap for retail or collection display as well as for transportation or in other instances when the cap is to be protected. Since the cap supporting device of the present application can also be used to support a cap during washing and/or drying of a cap, ventilation holes can be formed partially or entirely through the device. The cap supporting device can be formed as a solid block of material or can be formed as a shell or hollow generally hemispherical block. While the device tends to be self-securing within a cap, it can also be secured within a cap by means of clips which engage a portion of the device and extend over the outside of a cap. The cap supporting device can also include one or more storage compartments therein.

4 Claims, 2 Drawing Sheets

SUPPORTING DEVICE AND METHOD FOR PRESERVING THE SHAPE AND INTEGRITY OF A CAP

This application is a file wrapper continuation of 08/593,262 Jan. 29, 1996.

BACKGROUND OF THE INVENTION

The present invention relates in general to supporting and shaping hats and, more particularly, to a method and apparatus for supporting hats by means of a block of compressible, resilient material shaped generally to conform to the inside of a hat and being oversized relative to hats to be supported. For use of the currently preferred form of the device, it is gripped by the hand of a user, compressed, fitted inside a hat to be supported and released to secure it within the hat. While the present invention is applicable to supporting and shaping hats in general, it is particularly applicable to sports or ball caps and will be described herein with reference to this application. However, it is noted that herein, the word cap or caps should be interpreted as referring to hats in general.

Sports or ball caps typically are made from fabric and include forwardly projecting bills which can serve to shade the users eyes from the sun. Such caps are very popular not only for sports players but also for everyday use. Many different styles and grades of caps are available and serve to express an opinion of the wearer, to advertise a wide variety of products, to protect the wearer or for other common applications. After these caps have been worn for awhile, they usually become dirty and must be washed or thrown away. With the cost of caps going ever higher, the practice of washing Caps has become popular. Unfortunately, caps which have been washed, either by hand or by machine, tend to shrink or wrinkle badly upon unsupported drying.

Even before such caps need to be washed, they can become wrinkled and disfigured by being inadvertently crushed. For example, a cap may be place on a chair or table where books, papers or other materials may be placed on it. Caps may also become disfigured when thrown into a suitcase, duffel bag, golf bag, automobile seat or the like.

A variety of devices have been developed for supporting caps for drying after the caps have been washed. For example, reference can be made to U.S. Pat. Nos. 4,491,256; 4,941,601; 5,148,954; and, 5,161,719. While all of the cap supporting devices disclosed in the cited patents perform more or less successfully for drying washed or otherwise dampened caps, each has its own advantages and disadvantages.

In the interest of offering additional options and advancing the art, there is a need for new and improved cap supports which are simple to use and inexpensive. Any such improved cap support preferably would also serve to support caps for convenient display by retailers or collectors of caps.

SUMMARY OF THE INVENTION

This need is met by the method and apparatus of the invention of the present application wherein a block of compressible, resilient material, shaped generally to conform to the inside of a cap and sized somewhat larger than a cap to be supported, is compressed, inserted into a cap and released to secure the device within the cap. The cap supporting device can be used to support a cap for retail or collection display as well as for transportation. Since the cap supporting device of the present application can also be used to support a cap during washing and/or drying of a cap, ventilation holes can be formed partially or entirely through the device. The cap supporting device of the present application can be formed as a solid block of material or can be formed as a shell or generally hollow hemispherical block. While the device tends to be self-securing within a cap, it can also be secured within a cap by means of clips which engage a portion of the device and extend over the outside of a cap. One or more storage compartments may also be formed within the device for small items such as eyeglasses, eyeglass securing straps and other items commonly carried by persons using a cap.

In accordance with one aspect of the present invention, a supporting device for preserving the shape and integrity of a cap comprises a block of compressible, resilient material shaped generally to conform to the inside of a cap and being larger than a cap which is to receive the supporting device. The compressible, resilient material may comprise a hydrophobic material and ventilating holes extending from an exterior surface of the supporting device at least partially through the supporting device. Preferably, the ventilating holes extend entirely through the supporting device. The supporting device may further comprise at least two clips spaced around and secured to a lower surface of the block of compressible material for securing the supporting device to a cap.

In one embodiment, the supporting device includes an upper domed surface, a lower generally flat surface, a front end and a back end, with the supporting device further comprising a recessed area at its back end for hanging a cap including the supporting device contained therein. In another embodiment, the supporting device comprises a hollow, generally hemispherical shape having sufficient rigidity to support a cap when inserted therein. The supporting device may be sized at least five percent larger than a cap which is to receive the supporting device and is currently preferred to be sized between five and twenty five percent larger than a cap which is to receive the supporting device. The device may also comprise a storage compartment which, preferably, may be accessed through a bottom surface or a front surface of the device.

In accordance with another aspect of the present invention, a method for preserving the shape and integrity of a cap comprises the steps of: forming a cap supporting device as a block of compressible, resilient material shaped generally to conform to the inside of a cap and being larger than a cap which is to receive the supporting device; compressing, for example by manually gripping, the cap supporting device for insertion into a cap to be supported thereby; inserting the cap supporting device in a compressed state into the cap; and, releasing the cap supporting device within the cap whereby the cap supporting device is retained within the cap by frictional engagement between the released cap supporting device and the inside surface of the cap.

The method may further comprise the step of securing the cap supporting device to the cap. The step of forming a cap supporting device as a block of compressible, resilient material may comprise the step of forming the cap supporting device in a hollow, generally hemispherical shape having sufficient rigidity to support a cap when inserted therein. The step of forming a cap supporting device as a block of compressible, resilient material may comprise the step of forming the cap supporting device of a hydrophobic material.

It is, thus, an object of the method and apparatus of the present application to provide an improved cap support for washing, drying, protecting and displaying a cap; and, to provide an improved cap support formed of a material which can be compressed, inserted into a cap, and released to engage the inside of the cap.

Other objects and advantages of the invention will be apparent from the following description, the accompanying drawings and the appended claims.

DETAILED DESCRIPTION OF THE INVENTION

While the present invention is generally applicable for use with a wide variety of hats, it is particularly applicable to sports or ball caps and will be described herein with reference to such sports or ball caps. However, it is noted that cap or caps as used herein should be interpreted as applying not only to sports or ball caps but also to other hats for which the present invention can be utilized. Further, while the present invention can be used for washing and/or drying a cap after it has been washed or otherwise dampened, it can also be used for support of a cap for retail display, collection display, to maintain the shape of a cap during travel or otherwise and for similar applications.

Figure 2:
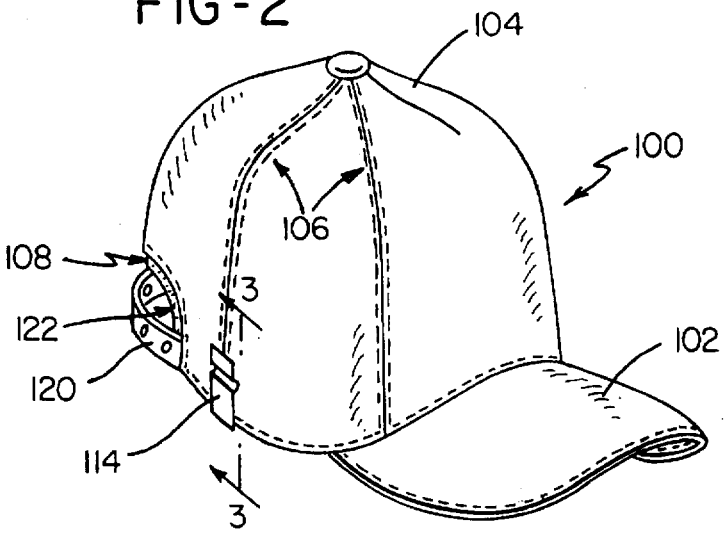
FIG. 2 is a perspective view of a sports or ball cap having the cap supporting device of the present invention inserted into the cap.
Figure 1:
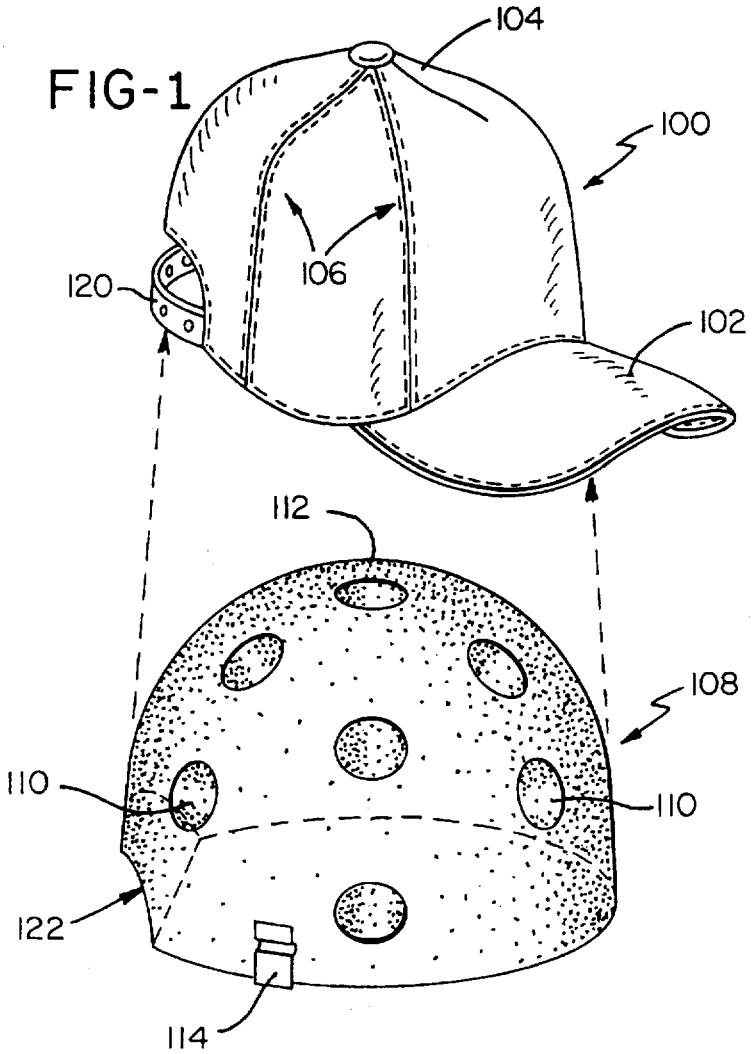
FIG. 1 is a perspective view of a sports or ball cap with the cap supporting device of the present invention shown positioned beneath the cap prior to being compressed and inserted into the cap.

Referring now to FIGS. 1 and 2, a cap 100 generally illustrates a sports or ball cap. The cap 100 includes a visor 102 attached to a crown section 104 which receives the topmost part of the head of a person wearing the cap 100. Dotted lines 106 represent portions of the cap 100 which typically wrinkle badly during drying after the cap 100 has been washed or otherwise heavily dampened.

Figure 4:
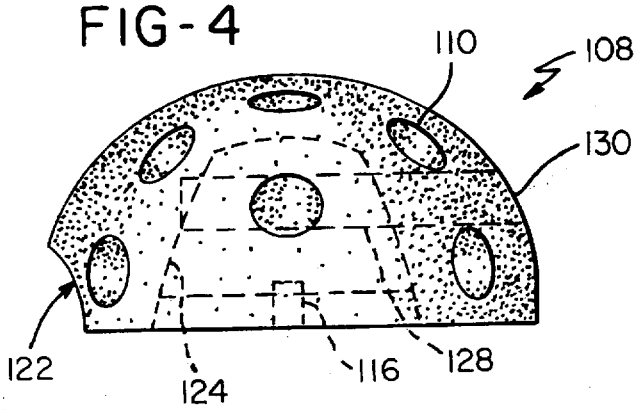
FIGS. 4 and 5 are side and bottom views, respectively, of the cap supporting device of FIG. 1.
Figure 5:
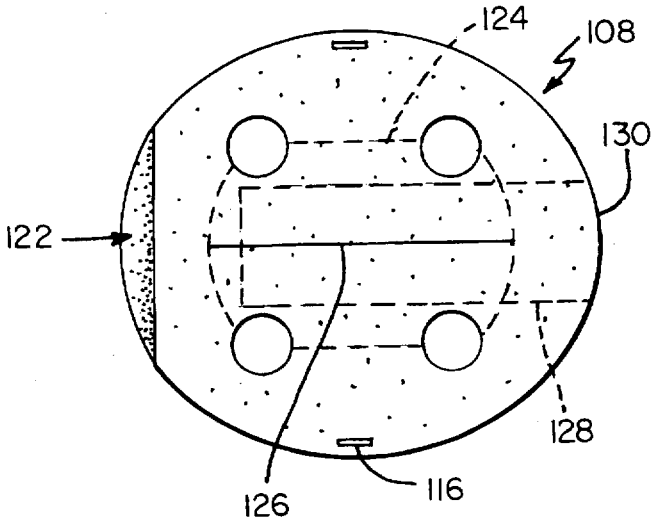

In accordance with the present invention, a cap supporting device 108 is provided for preserving the shape and integrity of the cap 100 for travel, washing, drying, display, storage and other applications. As best illustrated in FIGS. 2, 4 and 5, the cap supporting device 108 comprises a block of compressible, resilient material shaped generally to conform to the inside of the crown section 104 of the cap 100 and being sized larger than the cap 100 which it is to support.

A variety of materials can be used to make the cap supporting device 108 including but not limited to a large number of foams which are formed of hydrophobic material. Preferably, the material used to form the cap supporting device 108 resists mildewing itself or is treated to resist mildewing. To this end to facilitate drying of a cap which has become damp due to washing, rain, perspiration or otherwise, ventilating holes 110 extend from the upper external surface 112 at least partially through the cap supporting device 108.

For best air circulation, it is preferred to have the ventilation holes 110 extend entirely through the cap supporting device 108. When the ventilation holes 110 extend entirely through the cap supporting device 108, the holes 110 may be positioned in the bottom of the device 108 such that they can be gripped by a user's fingers to facilitate compression of the device 108, see FIG. 5.

While the material used to form a foam, which may be used to form the device 108 and is currently preferred, is hydrophobic, to enhance the compressibility of such foam, an open cellular structure is currently preferred. Open cellular structures, even of hydrophobic material, will absorb moisture within the open cells of the foam. If the cap supporting device 108 of the present application is used to support a cap during machine washing, much of the moisture absorbed by both the cap 100 and the cap supporting device 108 should be removed by the spin operation of the washing machine such that drying should not be substantially impacted. If the cap 100 is washed separately or otherwise becomes damp, the cap supporting device 108 formed of an open cellular structure material should withdraw moisture from the cap 100 such that the cap 100 will dry more rapidly. The cap supporting device 108 can then be removed from the substantially dry cap 100 and dried separately as necessary.

It is also possible to make the cap supporting device 108 from a closed cell foam material such that the cap supporting device 108 does not absorb moisture. However, when a closed cell foam material is used to make the cap supporting device 108, the device is much less compressible. Thus, it would be possible to use a closed cell foam material to construct the cap supporting device 108 if caps having a smaller range of cap sizes or a single cap size are to be supported. It is also possible to form the cap supporting device 108 from some combination of an open cell material and a closed cell material. For example, an inner core of closed cell material can be covered by an outer covering of open cell material. For this embodiment, the cap supporting device 108 could be compressed both by gripping and by forcing the cap supporting device 108 into the cap 100.

In any event, the cap supporting device 108 should be larger than the cap 100. For more compressible forms of the device 108, the preferred sizing is currently believed to be from approximately 5% larger to 25% larger than the crown section 104 of the cap 100. For less compressible forms of the device 108, a closer sizing of the device 108 to the cap 100 to be supported is provided.

The cap supporting device 108 should normally be retained within the cap 100 by means of the frictional engagement of the outer domed surface of the device 108 with the interior of the crown section 104 of the cap 100. However, where additional retention force is needed or desired, the cap 100 may be secured to the cap supporting device by a variety of means. For example, hat pins can be used to secure the cap 100 to the cap supporting device 108.

Figure 3:
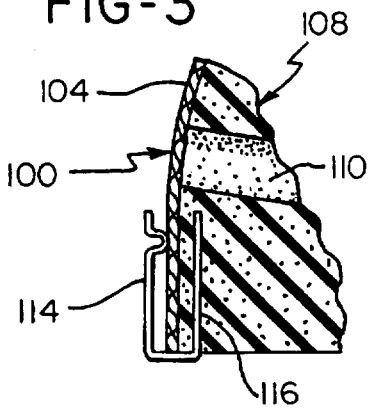
FIG. 3 is a sectional view taken along the section line 3—3 of FIG. 2 showing a clip device for securing a cap to the cap supporting device of the present invention.

Preferably, a variety of clips are used in combination with the cap supporting device 108. One such cap clipping arrangement is illustrated by a clip 114 which, as illustrated, is formed of a polymeric material in a generally U-shape with one leg of the U-shaped clip 114 being inserted into a slot 116 in the bottom of the cap supporting device 108, see FIGS. 1–3. The other leg of the U-shaped clip 114 is expanded to extend over the outer surface of the cap 100. As shown in FIG. 5, two slots 114 for receiving appropriate clips, such as the clips 114, are provided; however, any reasonable number of clips and slots can be provided for a given application. Other clipping arrangements will be suggested to those skilled in the art in view of this description.

Figure 6:
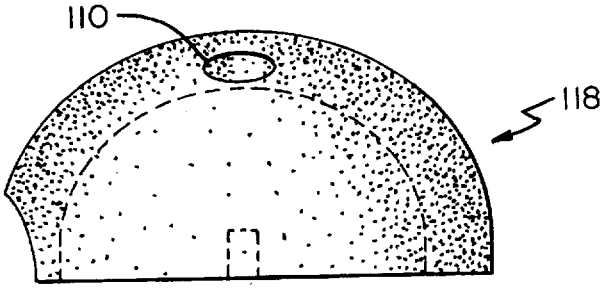
FIGS. 6 and 7 are side and bottom views, respectively, of an alternate embodiment of the cap supporting device of the present invention.
Figure 7:
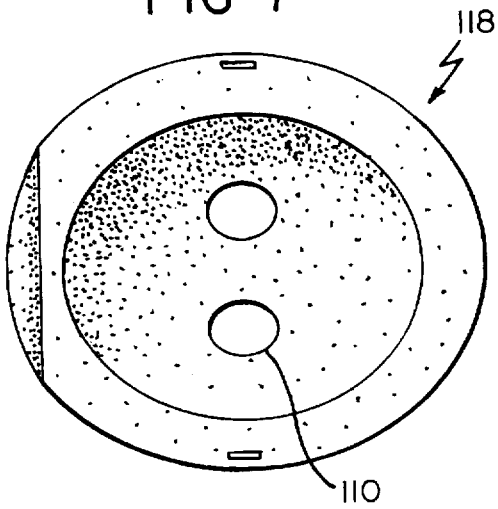

An alternate embodiment of the cap supporting device can be formed as a hollow, generally hemispherical shape as illustrated by the cap supporting device 118 shown in FIGS. 6 and 7. The thickness of the cap supporting device 118 depends upon the specific material which is used for its construction but the cap supporting device 118 must have sufficient rigidity or strength to support the cap 100 when inserted therein. Ventilating holes 110 can also be provided in the cap supporting device 118 as long as the ventilating holes 110 do not reduce the strength needed for properly supporting a cap into which the cap supporting device 118 is inserted.

For the hollow, generally hemispherical shape of the cap supporting device 118, an adjustable back strap 120 of the cap 100 can often be used to hang the cap 100 from a hook or other projection in a common hanging fashion. For the solid form of the cap supporting device 108 or in the event the thickness of the cap supporting device 118 is so great that hanging the cap 100 from its back strap 120 is not convenient, a recessed area 122 indentation or cutaway portion at the back end of the supporting device can be provided for hanging the cap 100 including the supporting device 108 or the cap supporting device 118 of the present application by the strap 120 of the cap 100.

The cap supporting device of the present application can also include a storage compartment formed within the device. For example, as illustrated in FIGS. 4 and 5, a storage compartment 124 may be hollowed out within the cap supporting device 108 either during formation of the device or afterwards. The storage compartment 124 is accessed through a slot 126 in the bottom of the device. Preferably, a thin slit extends from the slot 126 up into the device for a short distance of around an inch or so with the compartment 124 then expanding out to an appropriate size within the cap supporting device 108. When secured within a cap, the slot 126 tends to be forced closed to better secure items stored within the storage compartment 124.

Another example of a storage compartment is also illustrated in FIGS. 4 and 5 wherein a generally rectangular storage compartment 128, particularly applicable for holding a pair of eyeglasses, is formed into the cap supporting device 108 with an opening toward the front surface 130 of the cap supporting device 108. If the storage compartment 128 is open-ended as illustrated, it is closed and secured by the cap 100 when inserted therein as should be apparent. Of course, the compartment 128 can also be provided with a slot opening as described relative to the storage compartment 124. Other storage compartments/openings which also open from the sides or top of the cap supporting device 108 will be apparent to those skilled in the art from the foregoing description.

While it is believed that the method of using the invention of the present application should be apparent from the foregoing description, for the sake of clarity it will now be described. The method of the present application for preserving the shape and integrity of a cap comprises the steps of: forming a cap supporting device as a block of compressible, resilient material shaped generally to conform to the inside of a cap and being larger than a cap which is to receive the supporting device; compressing the cap supporting device, for example by manual gripping, such that it can be inserted into a cap to be supported thereby; inserting the cap supporting device in a compressed state into the cap; and, releasing the cap supporting device; within the cap whereby the cap supporting device is retained within the cap by frictional engagement between the released cap supporting device and the inside surface of the cap.

The method may further comprise the step of securing the cap supporting device to the cap, for example by clips, pins or otherwise. The step of forming a cap supporting device as a block of compressible, resilient material may comprise the step of forming the cap supporting device in a hollow, generally hemispherical shape having sufficient rigidity to support a cap when inserted therein. Preferably, the step of forming a cap supporting device as a block of compressible, resilient material comprises the step of forming the cap supporting device of a hydrophobic material.

Having thus described the invention of the present application in detail and by reference to preferred embodiments thereof, it will be apparent that modifications and variations are possible without departing from the scope of the invention defined in the appended claims.

What is claimed is:

1. A method for preserving the shape and integrity of a cap comprising the steps of:

forming a cap supporting device as a hemispherical block of compressible, resilient material having a substantially planar lower surface and an upper domed surface shaped generally to conform to the inside of a crown section of a cap and being larger than said cap to receive said supporting device;

compressing said cap supporting device including said upper domed surface by manually gripping said cap supporting device without substantial contact with said cap prior to insertion into said cap;

inserting said cap supporting device in the compressed state into said crown section of said cap; and releasing said cap supporting device within said crown section of said cap so that said cap supporting device is retained within said crown section of said cap by frictional engagement between the released cap supporting device and the inside surface of said crown section of said cap without extending substantially below a bottom portion of said crown section of said cap.

2. A method for preserving the shape and integrity of a cap as claimed in claim 16 further comprising the step of securing said cap supporting device to said cap.

3. A method for preserving the shape and integrity of a cap as claimed in claim 16 wherein said step of forming a cap supporting device as a block of compressible, resilient material comprises the step of forming said cap supporting device in a hollow, hemispherical shape having sufficient rigidity to support a cap when inserted therein.

4. A method for preserving the shape and integrity of a cap as claimed in claim 1 wherein said step of forming a cap supporting device as a block of compressible, resilient material comprises the step of forming said cap supporting device of a hydrophobic material.

* * * * *

UNITED STATES PATENT AND TRADEMARK OFFICE

CERTIFICATE OF CORRECTION

PATENT NO. : 5,725,134

DATED : March 10, 1998

INVENTOR(S) : Brian Richard Weltge

It is certified that error appears in the above-identified patent and that said Letters Patent is hereby corrected as shown below:

Col. 6, line 39, "supporting device within" should be --supporting device and allowing it to expand within--.

Col. 6, line 48, "claim 16" should be --claim 1--.

Col. 6, line 51, "claim 16" should be --claim 1--.

Signed and Sealed this

Second Day of June, 1998

*Attest:*

Bruce Lehman

BRUCE LEHMAN

*Attesting Officer*

*Commissioner of Patents and Trademarks*